US012806508B1

(12) United States Patent
Dean et al.

(10) Patent No.: US 12,806,508 B1
(45) Date of Patent: Nov. 24, 2026

(54) ELECTRONIC DICE APPARATUS AND METHOD

(71) Applicants: Jason Dean, Norwalk, CT (US); Nicholas Dean, Attleboro, MA (US); Ryan Grandmaison, Fairhaven, MA (US); Justin Albanese, Cranston, RI (US); Blake Simmons, Plymouth, MA (US)

(72) Inventors: Jason Dean, Norwalk, CT (US); Nicholas Dean, Attleboro, MA (US); Ryan Grandmaison, Fairhaven, MA (US); Justin Albanese, Cranston, RI (US); Blake Simmons, Plymouth, MA (US)

( * ) Notice: Subject to any disclaimer, the term of this patent is extended or adjusted under 35 U.S.C. 154(b) by 250 days.

(21) Appl. No.: 18/670,551

(22) Filed: May 21, 2024

Related U.S. Application Data

(60) Provisional application No. 63/503,813, filed on May 23, 2023.

(51) Int. Cl.
*A63F 3/00* (2006.01)

(52) U.S. Cl.
CPC ..... *A63F 3/00643* (2013.01); *A63F 3/00176* (2013.01); *A63F 2003/00195* (2013.01); *A63F 2003/00662* (2013.01)

(58) Field of Classification Search
CPC ..... A63F 3/00643; A63F 3/00176; A63F 2003/00195; A63F 2003/00662
USPC ..... 273/237
See application file for complete search history.

(56) References Cited

U.S. PATENT DOCUMENTS

2015/0069702 A1* 3/2015 Wouhaybi ..... A63F 3/00006 273/237
2015/0286322 A1* 10/2015 Duteil ..... H04B 5/77 345/173
2015/0339021 A1* 11/2015 Duteil ..... G06F 3/0487 345/156
2021/0052972 A1* 2/2021 Botta ..... A63F 9/0468

* cited by examiner

*Primary Examiner* — Jacob K Ackun
(74) *Attorney, Agent, or Firm* — W Scott Keeley; Keeley DeAngelo LLP

(57) ABSTRACT

An apparatus and method for electronic dice gaming uses a set of electronic dice, an electronic tray and interpretation software. The dice and tray use near-field communication to receive and transmit roll data to a remote computer. The remote computer uses interpretation software to present the dice-roll results to gamers at remote locations. The purpose is to bridge the gap between physical and digital tabletop game play.

10 Claims, 6 Drawing Sheets

100

100

ELECTRONIC DICE APPARATUS AND METHOD

TECHNICAL FIELD

The present disclosure relates to electronic and physical gaming systems used in virtual tabletop gaming.

BACKGROUND

Virtual tabletop games (VTTs) or digital tabletop games are a type of video game, usually played online with remote players, that simulates a physical tabletop board game, card game, or role-play game. Many online games use virtual, online dice to enable participation of multiple remote players as well as transparency in play. Virtual dice are online dice animations that vary from a simple cube dice to multiple dice with multiple faces, as well as combinations of those. These dice use web-based scripts to simulate random dice-throw results. Because online dice-throws are generated by mathematical formulas, gamers are left to feel that true randomness is not achieved as it is with physical dice, and that pseudo-randomness generated by number algorithms removes the sense of chance and human control from the game. A combination electronic dice tray, electronic dice, and software would provide interaction between real-time, physical dice-throwing and online games.

Dice trays are commonly used in physical tabletop gaming to control where the dice land.

In the context of this disclosure, an increment of time is called a "tick."

Near-field communication (NFC) uses inductive coupling to connect compatible electronic devices wirelessly over very small distances (1.5 inches or less) to transmit data between devices. It is commonly used in electronic key cards and point-of-sale credit-card transactions. NFC uses tags, which are small, passive devices that enable communication with active devices. In this disclosure, an NFC data stream is a set of data communicated between a devices with NFC tags.

NFC is a specific subset of RFID technology that uses High-Frequency (HF) RFID, operating at a frequency of 13.56 MHz. NFC is considered by many to be a more secure form of data exchange than the broader RFID. Because an NFC device may serve as either a reader or a tag, it is used in peer-to-peer communication.

Radio-frequency identification (RFID) uses electromagnetic waves to identify and communicate information between a radio-frequency device and a receiver. RFID tags are used, for example, in electronic toll-collection, with an RFID tag on the car's device and an RFID reader at the toll gate.

Compared with NFC, the broad communication technology of radio-frequency identification (RFID) communicates in a physical range of about four inches to 700 feet, depending on the power level and frequency used by the device.

A Digital Random Number Generator (DRNG) generates nearly random numbers by algorithms rather than by physical means.

An API is an application programming interface. An Isolate is a machine API that isolates and controls Java application lifecycles within a single Java Virtual Machine (JVM) or between multiple JVMs.

A website may read from and write to serial devices through a Web Serial API or "web serial connection." A device may be connected via serial port, USB or Bluetooth device that emulates a serial port.

Representational state transfer (REST) is a software architectural style that provides standards between computer systems on the web, enabling systems to communicate with each other. The REST architecture enables clients to send requests to retrieve or modify resources, and servers to send responses to these requests. REST-compliant systems (aka RESTful systems) allow code on a client side to be altered at any time without affecting the operation of the server, and allow code on the server side to be changed without affecting the operation of the client.

An icosahedron is a polyhedron with 20 faces.

SUMMARY

An apparatus and method for electronic dice gaming uses a set of dice that are modified to include electronic components (hereafter referred to as electronic dice), an electronic tray, and interpretation and communication software. The dice and tray use near-field communication to receive and transmit roll data to a remote computer. The remote computer uses interpretation and animation software to present the dice-roll results to gamers at remote locations. The purpose is to bridge the gap between physical and digital tabletop game play.

The disclosed apparatus may offer from 2 to 20 die faces, indicated as D2, D4, D6, D8, D10, D12, D20 ("D" indicating die and the numerical value indicating the number of faces).

In the disclosed method, each die contains passive near-field communication (NFC) tags embedded in each face. These NFC tags communicate values to an electronic tray, which sends information via USB or wirelessly to a computer, which then propagates the information to a host computer to be shared with other players.

The NFC tags communicate the following values:

An identifier value unique to the die that indicates which die has been rolled, as well as its color, style, manufacture lot and number A numerical value representing the number of die faces A numerical value representing the value of the roll. The value of the roll is the value counted as a result of the roll. The value counted is most commonly on the side opposite the read NFC tag.

The apparatus's dice tray is a read/write device with a fitted antenna connected to an NFC reader in the tray. The tray connects to and receives power from USB or other connection to a computer. One skilled in the art understands that power may be through various sources, including AC or battery.

The disclosed apparatus and method specifically uses NFC because only nearby data is to be read, and only from one die face at a time. It is the "near" aspect of NFC that specifically enables close reading of one die face at a time. RFID is not used because its range is inappropriate; an RFID tag would enable all die faces to communicate to the antenna simultaneously.

The method uses interpretation software on the connected computer to interpret dice rolls according to:

The results of the roll and total number of results.

The orientation of the dice.

The type of dice rolled.

The method's software reads, controls, formats and exports dice-roll data from the local computer to a host machine via serial output. In reading, the embedded software listens for and receives a stream of data for each die once the die comes into range of the reader hardware in the tray. It then writes custom face values or unique identifiers. The tray writes or re-writes data to the dice. All read information is interpreted by the software embedded in the tray. The embedded software processes the stream of incoming data by use of algorithms to perform the following:

Isolate streams for each NFC tag (die) being read

Confirmation that a die has stopped moving

Confirmation that the die being read has been rolled rather than placed on the tray Calculation of a result.

Embedded software captures the values sent by each NFC tag on each face of each die once the steps above have been completed. It then parses the captured values and formats them into a single data structure containing all values for each die recorded. After that, it exports the formatted data structure as individual bits via serial transmission. This transmission employs standard security features to prevent the use of third-party solutions to compromise functionality.

The interpretation software can interpret the above data locally, or export it through various APIs specific to the many virtual tabletops used in current online gaming systems.

After the signals have been interpreted, one of two sets of steps are followed:

1. Through a standard driver, the data is led to a web plugin or API that connects to third-party, virtual tabletops (VTTs). VTTs employ systems that convert digital RNG outputs into graphically represented 3D dice using open-source methods (e.g., Canon.js) which are known in the art.
2. Through the use of a proprietary, virtual tabletop method that employs open-source methods, physics libraries and custom-3D textures, data is converted and output to graphically represented 3D dice.

The interpretation software may use Javascript to display virtual rolling 3D dice that animate the results. These are known in the art.

Electronic dice may be made of poured resin as is typical in the art.

DESCRIPTION

Figure 1:
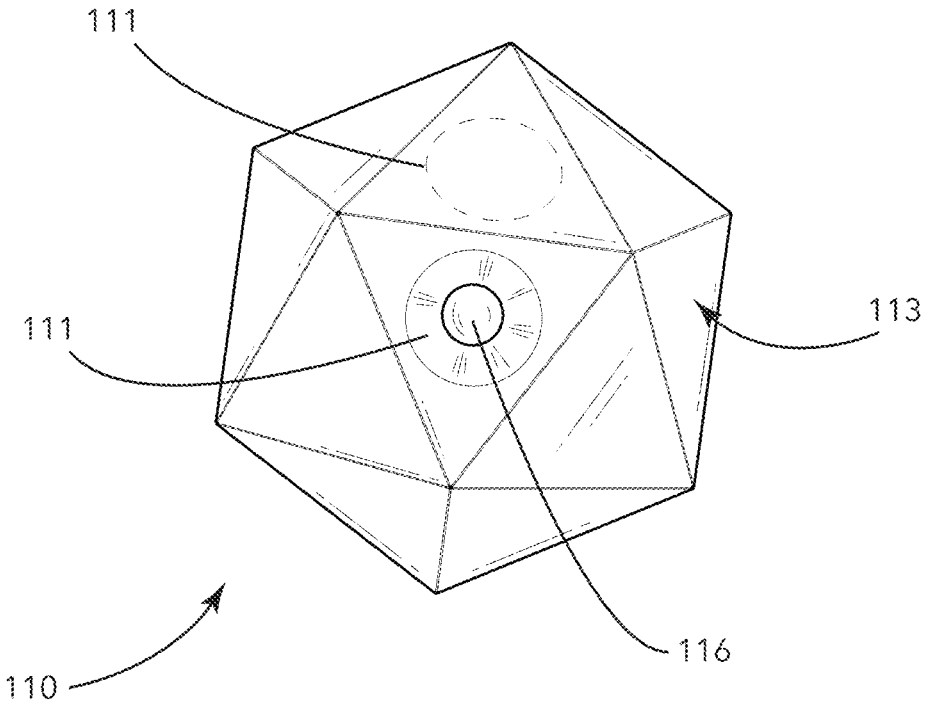
FIG. 1 is a perspective view of one iteration of a die.

FIG. 1, 100 shows an iteration of a die as an icosahedron 110 with an example small-form, low-range NFC device 116 embedded in an indention 111 in each die face 113 (with only one shown). One skilled in the art understands that the NFC devices may be overlaid with a die material such as resin.

Figure 2:
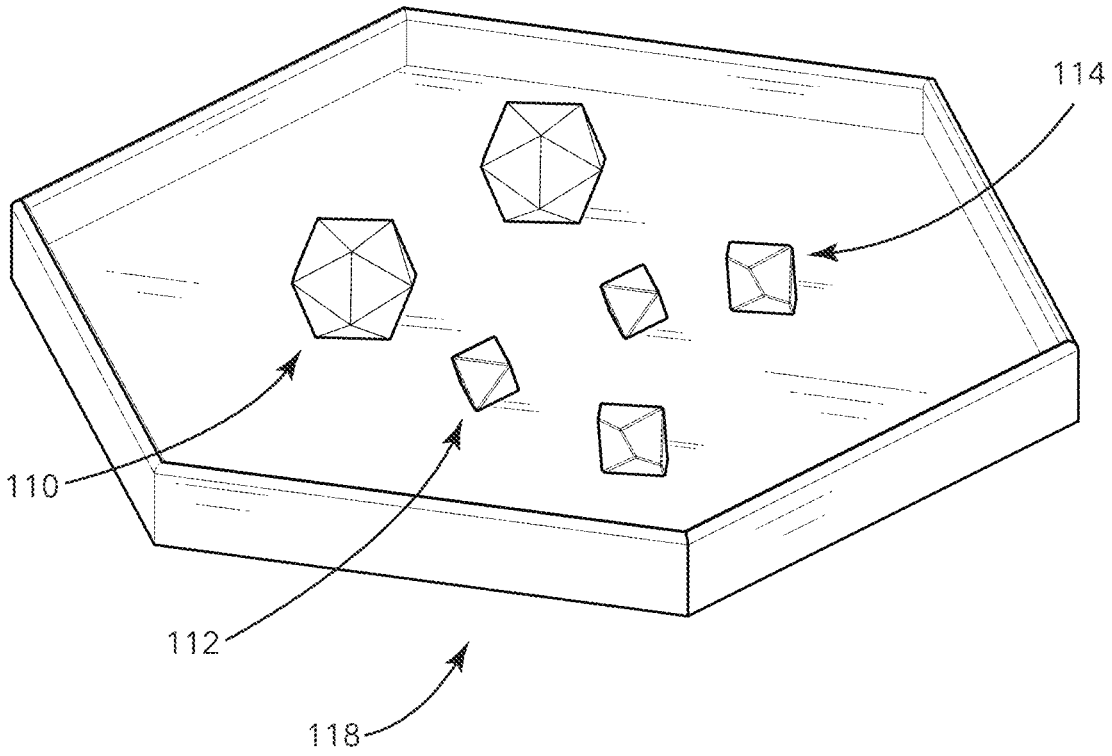
FIG. 2 is a top, perspective view of some of the dice iterations in an NFC tray.

In an iteration, FIG. 2 shows some of the dice 110, 112, 114 in an NFC tray 118.

Figure 3:
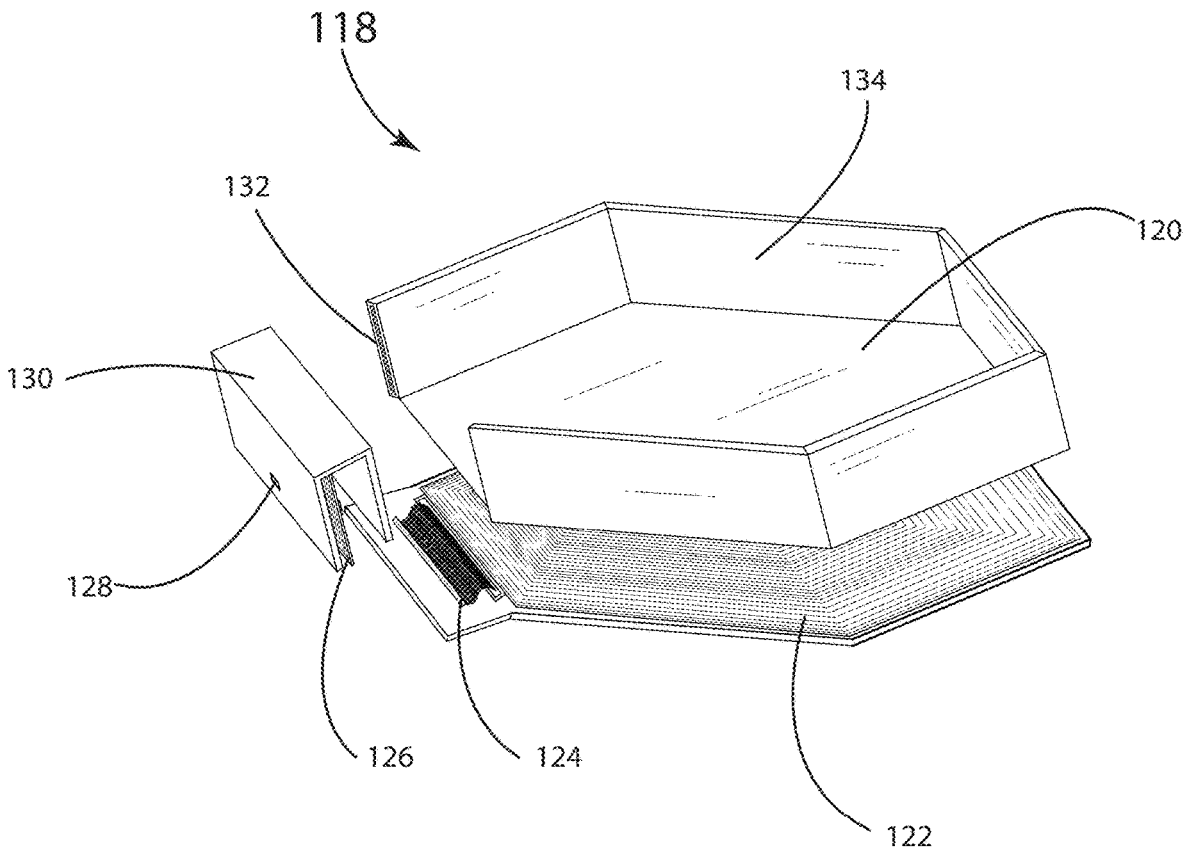
FIG. 3 is an exploded view of the tray.

FIG. 3, 100 is an exploded view of an NFC tray 118 which has a read/write area 120 (also referred to as a read/write field or "rollable area" or "play surface") and tray walls 134. An NFC antenna array 122 is located beneath the field 120 and is electronically coupled with a printed circuit board (PCB) connector 124 which connects the antenna array 122 to the PCB 126. On the exterior of the PCB housing 130, a user-accessible serial port 128 is connected to the PCB. Internal shielding 132 is embedded in the NFC tray to prevent external reading/writing. One skilled in the art understands that the components of an NFC tray may be placed in various locations on the tray while still encompassing the scope of the invention; for example the PCB housing 130 may, in some embodiments, be located beneath the NFC antenna array 122. One skilled in the art is familiar with wireless connectivity and further understands that a wireless connection might be used in place of a user-accessible serial port 128 and its related function.

Figure 4:
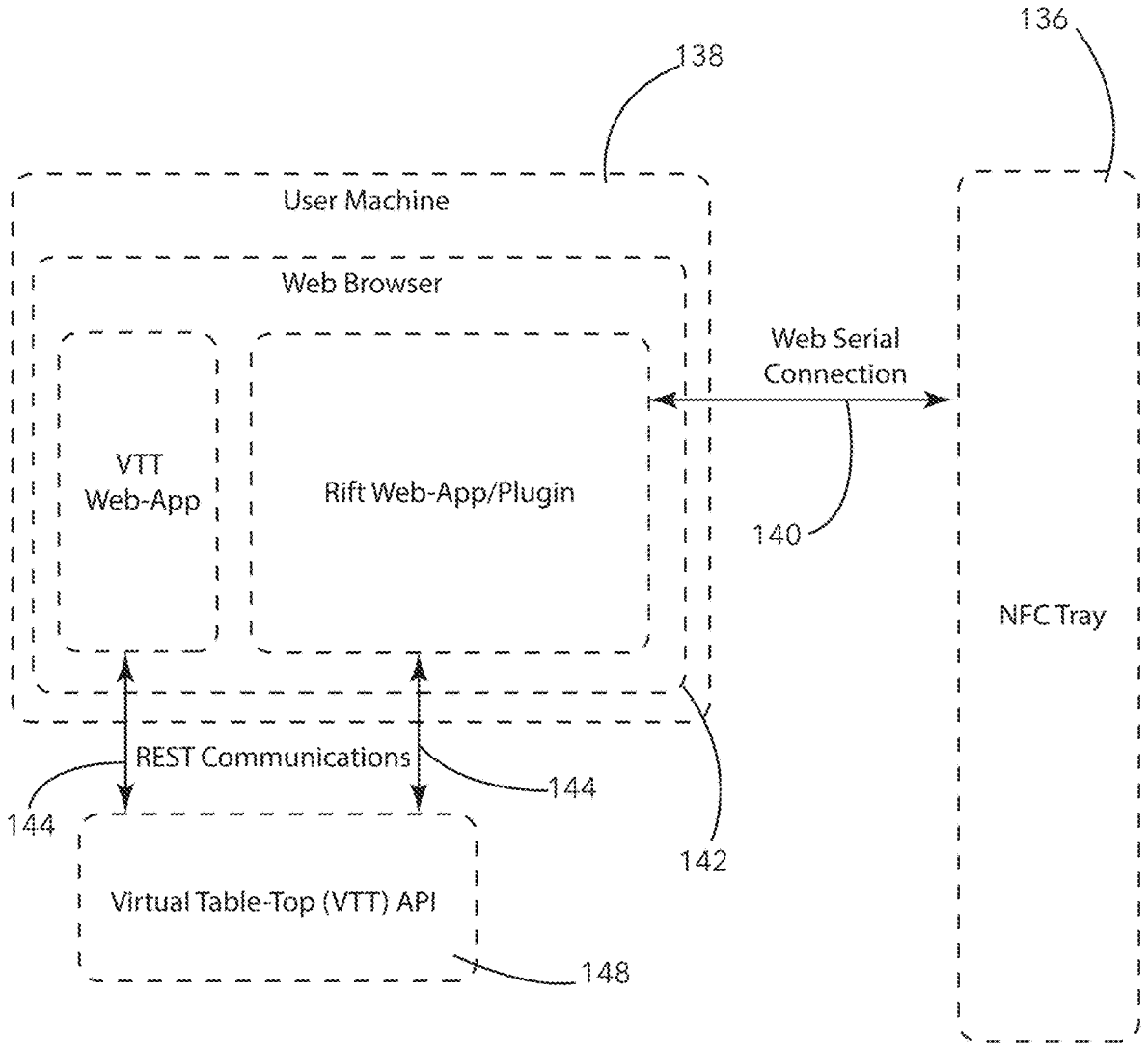
FIG. 4 is an illustration of an iteration of the embodiment's software architecture.

FIG. 4 100 is a map of an iteration 100 of the embodiment's software architecture. Dice-roll results are read by the apparatus's NFC tray 136 and communicated to a user's computer 138 through web serial connection 140. Browser-based VTT apps and web plugins 142 communicate via REST communications 144 to VTT APIs 148 to remote gamers.

Figure 5:
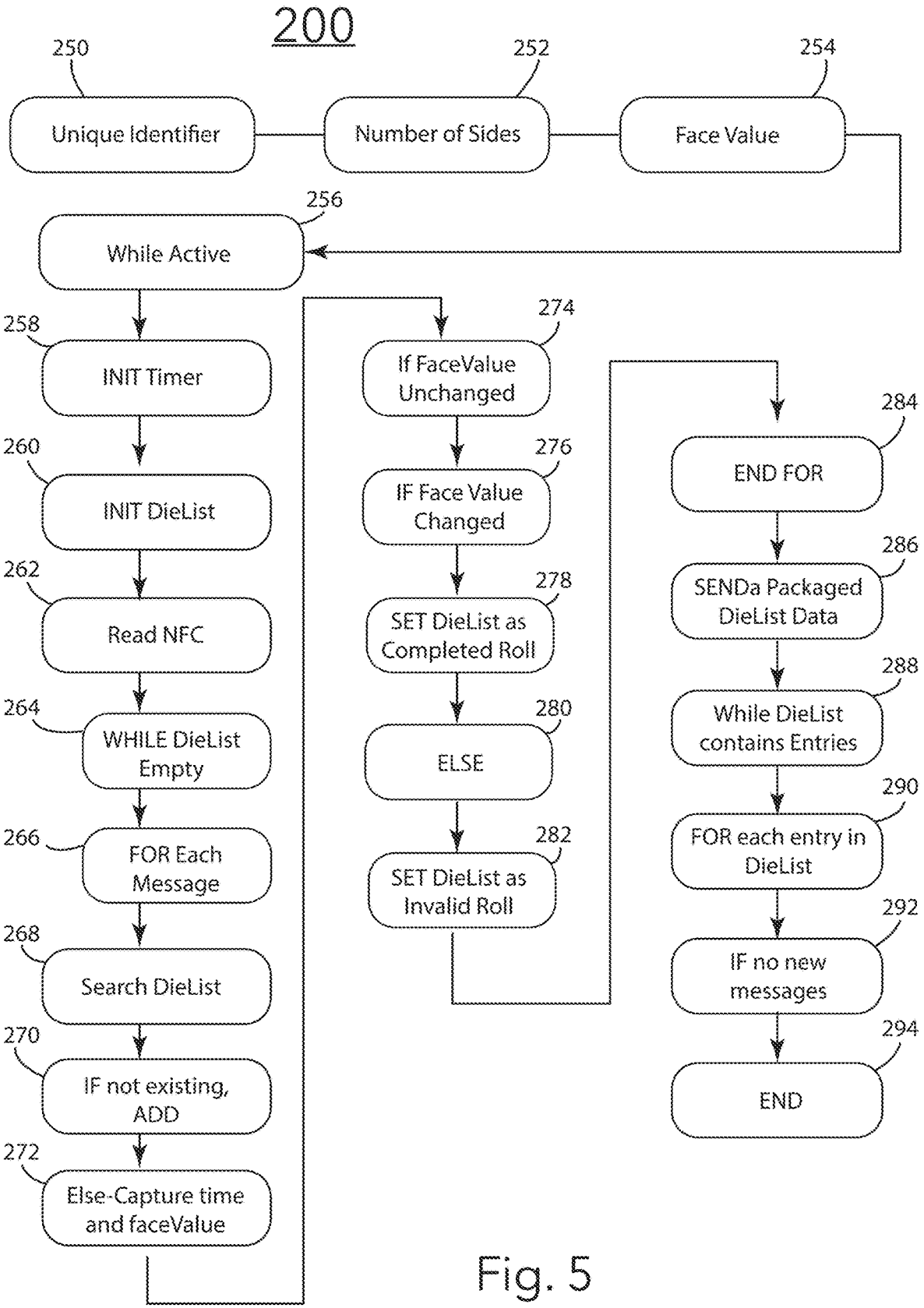
FIG. 5 is a flowchart of an iteration of the software's actions.

FIG. 5 is a diagram of an iteration 200 of example pseudocode for describing an embedded software program in a method of the embodiment. These notional algorithms describe actions in a programming-language-agnostic manner. The algorithms assume an input stream which receives an input message containing data from each tag on a given die, each time it is read. Each tag message contains a value for each of the following: A unique identifier for the parent die (id) 250, a number of sides of the parent die (sides) 252, and a number reflecting the face value of the die when rolled. A die has a number of sides and a number of NFC tags embedded in each face. Each die is serialized such that a single die having multiple NFC tags is labeled as a single parent. The face value is the side opposite the tag being read (Face Value) 254. One skilled in the art understands that a unique identifier (also referred to as a die ID value or die ID) may correspond to the die manufacturer, the die appearance, or the like. One skilled in the art further understands that "face value" is the value recorded from the uppermost face once a die has been rolled. The NFC tag nearest the antenna is in a die face that is downwardly oriented toward the NFC antenna. It is this die face that carries the information of the corresponding face value of the rolled die. One skilled in the art understands that an example 20-sided die may have a face value that might be inclined toward rather than directly opposite the face that communicates with the antenna. In the case of a "cocked" die, or a die that has landed leaning against the side of the game tray, the resulting data stream identified by the tray is of a signal strength beneath that of a defined threshold. Such a signal strength would trigger an invalid roll result, and would trigger a signal to communicate to a user to roll the dice again.

A series of commands occur while the dice tray is active 256. A timer is initiated 258 leading to a "die list" initiation 260. The die list tracks and updates dice-roll values. One skilled in the art understands that a die list may include identifying characteristics of a die, its number of sides, pips, and the like. The die list may also include identifiers for each die rolled in a group of dice. The process continues, reading the NFC input stream 262. When the die list is empty 264, or not all die have been set to a "completed" die-roll status, for each message received 266 from the input stream, the program will search the die list 268 for an entry with the received die ID value. If no ID value is found, the program will add it as an entry 270 (via ELSE 272). A section of the program handles a constant feed of tag-reads by tracking each ID being read and updating each value, capturing the current time and face value in the most recent entry. The program checks a condition that may indicate a die has completed its roll by monitoring whether the face value remains unchanged for a given number of ticks 274, or, if the die has not completed its roll, by monitoring whether the face value changes after a given number of ticks 276. A "given number of ticks" means a predetermined period of time, for example, three seconds or fewer.

In some embodiments, the program determines whether a roll has been executed or the die has simply been placed in the tray. The program makes this determination by ensuring that the face value has changed a predetermined number of times within a predetermined duration. A completed roll is determined 278 after the face value remains unchanged for a given number of ticks 274. Otherwise (ELSE 280) the die list is set to Invalid Roll 282. If an invalid roll has not occurred, the information related to a completed roll 278 is then sent to the command END FOR 284 which follows the command SEND 286, wherein packaged die-list data is sent in a properly formatted message to an external device.

When the die list contains entries 288, then FOR each entry in the die list 290, the program will listen for new messages containing respective IDs; if no new messages have been received 292 in a given number of ticks, the entry is removed and the program clears the die list as die/dice are removed from the tray to End the program 294. One skilled in the art understands that a "given number of ticks" may be defined as a predetermined period of time, for example, three seconds or fewer.

Figure 6:
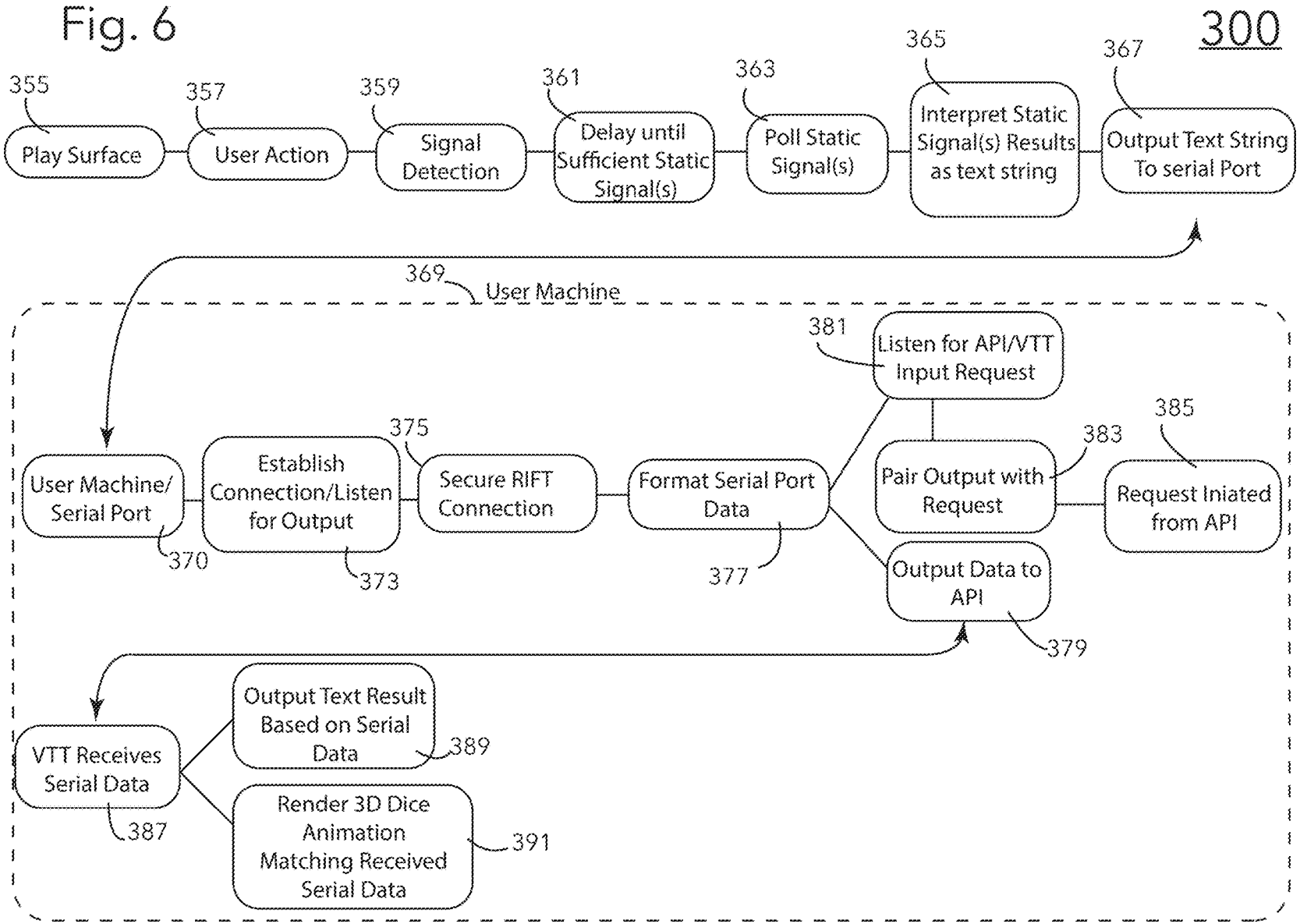
FIG. 6 is a flowchart of an iteration of the software flow.

FIG. 6 shows the software flow 300 of the web app's software receiving data from the tray. At an event of user action 357 on the dice tray 355, the method detects a signal 359, delaying until sufficient static signal is received 361, then polls static signal(s) 363; interprets static-signal results as text string(s) 365; and then outputs text string(s) 367 via serial port to a user machine 369. Components of the user machine 369 are surrounded by a dashed outline. A connection is established 373 at the user machine's serial port 370, where it listens for output 373 and proceeds to make a secure connection 375; format serial-port data into a readable string that can be understood by the web terminal 377; and proceed in one of two directions: listen for API/VTT input request 381, then pair output with the request 383, then initiate request with an API 385; or output data to an API 379. From there, the VTT receives serial data 387 where it proceeds to either output it as text based on serial data 389 or render 3D dice animation, matching received serial data 391.

Formatting serial-port data 377 involves packaging the roll data received from the tray into a format that can be ingested by the receiving API. This involves populating HTTP request values and JSON data structures with relevant values, including the roll values received from the tray.

In the context of data transmission over ports, "listening" for API/VTT input request 381 refers to the state of a port where it is currently accepting incoming data.

The above describes example embodiments of the disclosed apparatus and method, and should not be construed as limiting.

The invention claimed is:

1. A computer-executed method of using an apparatus configured to digitally communicate the roll of a die, the apparatus comprising a die having a plurality of die faces, an NFC tag embedded in each of said plurality of die faces, and an NFC antenna proximal to said NFC tag(s), wherein said die is rolled in proximity of said NFC antenna, wherein an NFC tag in closest proximity to said NFC antenna is detected and read by said NFC antenna for conversion to computer-readable data sent via NFC the method comprising:

initializing a timer while said NFC antenna is active; and
initializing a die list; and
receiving NFC data stream from said NFC antenna; and
reading NFC tag information in said NFC data stream; and
capturing die ID value, time and die-face value; and
formatting captured die information into a data structure; and
monitoring die-face value for a predetermined period of time; and
determining that a die-face value has not changed for said predetermined period of time; and
setting a roll of a die as complete when said die-face value remains unchanged for said predetermined period of time; and
sending computer-readable data containing said single data structure of each die to an external device.

2. The method of claim 1 further comprising:
searching said die list for each message received through said NFC data stream; and
adding a die list item if a message received through said NFC data stream is not in said die list.

3. The method of claim 1 further comprising:
setting a roll of die to invalid when said die-face value does not remain unchanged for said predetermined period of time.

4. The method of claim 1 further comprising:
listening for NFC data stream; and
clearing die list when no new information is received for a predetermined period of time.

5. The method of claim 1 wherein:
said data structure further comprises orientation of die and type of die rolled.

6. The method of claim 1, further comprising:
providing that at least one die is rolled across said play surface; and
detecting at least one signal from said NFC tag in one of said plurality of die faces; and
delaying action until said at least one signal remains static for a predetermined period of time; and
polling said at least one signal that has remained static; and
interpreting said at least one signal as a text string; and
sending said text string to a local computer.

7. The method of claim 6 further comprising:
listening for an API/VTT input request; and
pairing said text string as output with said input request; and
initiating a request with said API; and
formatting said text string as serial-port data; and
outputting said serial-port data to said API/VTT; and
receiving said serial-port data by said VTT.

8. The method of claim 6 further comprising:
converting said serial-port data to text; and
displaying said text in said VTT.

9. The method of claim 6 further comprising:
measuring signal strength by the antenna; and
sending measured signal strength as part of said serial-port data; wherein
a signal strength below a predetermined threshold triggers an invalid roll result.

10. The method of claim 6 further comprising:

rendering a 3D animation according to said serial-port data; and displaying said 3D animation in said VTT.

* * * * *